US009401570B2

(12) United States Patent
Phillips et al.

(10) Patent No.: US 9,401,570 B2
(45) Date of Patent: Jul. 26, 2016

(54) ELECTRICAL CONNECTOR HAVING GROUND BUS BAR

(71) Applicant: Tyco Electronics Corporation, Berwyn, PA (US)

(72) Inventors: Michael John Phillips, Camp Hill, PA (US); Randall Robert Henry, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/526,690

(22) Filed: Oct. 29, 2014

(65) Prior Publication Data

US 2016/0126678 A1 May 5, 2016

(51) Int. Cl.
*H01R 13/648* (2006.01)
*H01R 13/6585* (2011.01)

(52) U.S. Cl.
CPC ..... *H01R 13/6585* (2013.01)

(58) Field of Classification Search
CPC . H01R 23/688; H01R 13/65802; H01R 23/68
USPC ..... 439/108, 607.05, 607.28, 607.32, 660
See application file for complete search history.

(56) References Cited

U.S. PATENT DOCUMENTS 5,120,232 A * 6/1992 Korsunsky ..... H01R 23/6873 439/108
5,259,772 A * 11/1993 Fusselman ..... H01R 23/688 439/108
6,290,515 B1 * 9/2001 Lee ..... H01R 23/688 439/108
7,131,874 B2 * 11/2006 Kuroda ..... H01R 13/65802 439/108
7,320,623 B2 * 1/2008 Hisamatsu ..... H01R 12/721 439/108
7,458,829 B2 * 12/2008 Shioda ..... H01R 12/57 439/108
7,585,185 B2 * 9/2009 Obikane ..... H01R 13/65802 439/108
7,909,648 B2 * 3/2011 Tai ..... H01R 13/65802 439/607.32
8,221,139 B2 7/2012 Qin et al.
8,371,882 B1 * 2/2013 Szczesny ..... H01R 12/722 439/660
8,545,240 B2 10/2013 Casher et al.
8,702,451 B2 * 4/2014 Luo ..... H01R 12/725 439/607.28
8,764,464 B2 7/2014 Buck et al.
8,858,243 B2 * 10/2014 Luo ..... H01R 13/652 439/108
8,864,506 B2 * 10/2014 Little ..... H01R 13/6585 439/108
8,944,849 B1 * 2/2015 Yang ..... H01R 13/6588 439/607.07

* cited by examiner

*Primary Examiner* — Thanh Tam Le

(57) ABSTRACT

An electrical connector includes a housing, signal contacts and ground contacts, and a ground bus bar. The housing has a first side wall and a second side wall that define a socket at the front end of the housing. The socket is configured to receive a mating connector therein. The signal and ground contacts are held in the housing and interspersed along at least one of the first or second side wall. The signal and ground contacts extend into the socket to mate with corresponding mating signal contacts and mating ground contacts, respectively, of the mating connector. The ground bus bar is coupled to the housing at the first side wall of the socket. The ground bus bar includes spring contacts that extend into the socket and are configured to engage corresponding mating ground contacts of the mating connector to electrically common the mating ground contacts.

20 Claims, 5 Drawing Sheets

ELECTRICAL CONNECTOR HAVING GROUND BUS BAR

BACKGROUND OF THE INVENTION

The subject matter herein relates generally to electrical connectors that have ground bus bars that electrically common ground contacts.

Typically, high speed electrical connector systems experience significant electrical interference, such as cross-talk and resonant frequency noise, within the mating or interface zone where two electrical connectors electrically engage each other. For example, within the mating zone, high speed connectors may exhibit resonance spikes, which degrade signal transmission performance of the connectors. To improve performance by reducing the electrical interference in the mating zone, some known electrical connectors include ground tie bars that are in or at least close to the mating zone. The ground tie bars are configured to electrically connect grounding elements, such as ground contacts, which reduces resonance spikes across the mating zone and increases the resonant frequency to values above the range that signals are transmitted across the mating zone.

The ground tie bars typically are located on a plug connector to mechanically engage plug ground contacts and/or on a mating receptacle connector to mechanically engage receptacle ground contacts. However, adding additional components that interface with the ground contacts of the plug and/or receptacle connectors often complicates efforts to control the alignment between the plug and receptacle contacts as well as the normal forces exerted between the contacts during mating. For example, the receptacle ground contacts may be beam contacts configured to deflect outward a specified degree upon engaging corresponding plug ground contacts, but a ground tie bar housed on the receptacle outward of the receptacle contacts may exert an inward force on the receptacle contacts upon engaging the receptacle contacts. Thus, the deflectable beam contacts experience opposing forces from the mating plug contacts and the ground tie bar, and the compounding of normal forces could misalign the plug and receptacle ground contacts and detrimentally affect the electrical performance of the connector system. It may be complicated and difficult to design the receptacle and/or plug of a connector system to control the alignment and normal forces at the mating interface when a secondary contact of the ground tie bar is configured to ride on a primary receptacle contact that in turn engages a primary plug contact. Furthermore, some connector systems include a ground tie bar assembled into the plug connector instead of the receptacle, such that contacts of the ground tie bar engage corresponding plug ground contacts. However, the plug ground contacts may be stationary and non-deflectable, so the non-separable interface between the plug ground contacts and the ground tie bar may suffer from corrosion and debris. In addition, the contact point at the interface between the ground tie bar and the plug ground contact may be farther away from the mating interface between the plug contacts and the receptacle contacts than desirable, which limits the reduction of electrical interference across the mating zone.

A need remains for electrically commoning ground contacts in the mating zone to reduce electrical interference that avoids the problems of known ground tie bars in connector systems identified above.

BRIEF DESCRIPTION OF THE INVENTION

In an embodiment, an electrical connector includes a housing, signal contacts, ground contacts, and a ground bus bar.

The housing has a front end and an opposite rear end. The housing has a first side wall and a second side wall that define a socket at the front end. The socket is configured to receive a mating connector therein. The signal and ground contacts are held in the housing along at least one of the first or second side wall. The signal contacts and the ground contacts are interspersed across a width of the housing. The signal contacts and ground contacts extend into the socket to mate with corresponding mating signal contacts and mating ground contacts, respectively, of the mating connector. The ground bus bar is coupled to the housing at the first side wall of the socket. The ground bus bar includes spring contacts that extend into the socket and are configured to engage corresponding mating ground contacts of the mating connector to electrically common the mating ground contacts.

In another embodiment, a connector system includes an electrical connector and a mating connector. The electrical connector includes a housing having a front end and an opposite rear end. The housing has a first side wall and a second side wall that define a socket at the front end. The housing holds signal contacts and ground contacts along at least one of the first or second side wall. The signal contacts and the ground contacts are interspersed across a width of the housing and extend into the socket. The electrical connector further includes a ground bus bar coupled to the housing at the first side wall of the socket. The ground bus bar has spring contacts that extend into the socket. The mating connector includes a holder having an interface region. The holder holds mating signal contacts and mating ground contacts along at least one outer surface of the holder at the interface region. The mating signal contacts and mating ground contacts are interspersed across a width of the holder. As the electrical connector and the mating connector are mated, the interface region of the mating connector is received in the socket of the electrical connector. The mating ground contacts of the mating connector engage the spring contacts of the ground bus bar to electrically common the mating ground contacts. The mating signal contacts and mating ground contacts of the mating connector engage respective signal contacts and ground contacts of the electrical connector.

DETAILED DESCRIPTION OF THE INVENTION

Figure 1:
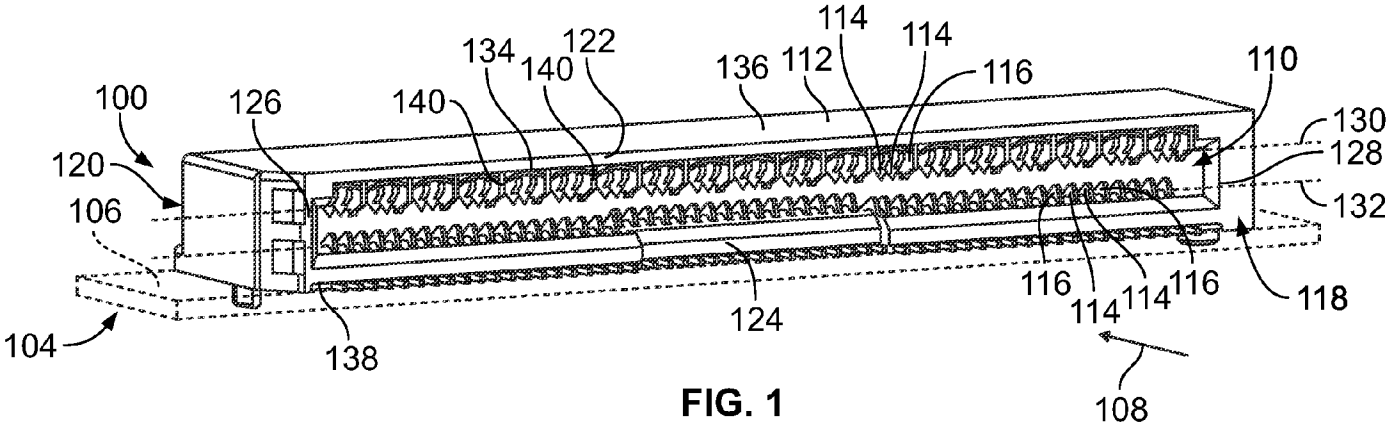
FIG. 1 is a perspective view of an electrical connector according to an embodiment.
Figure 2:
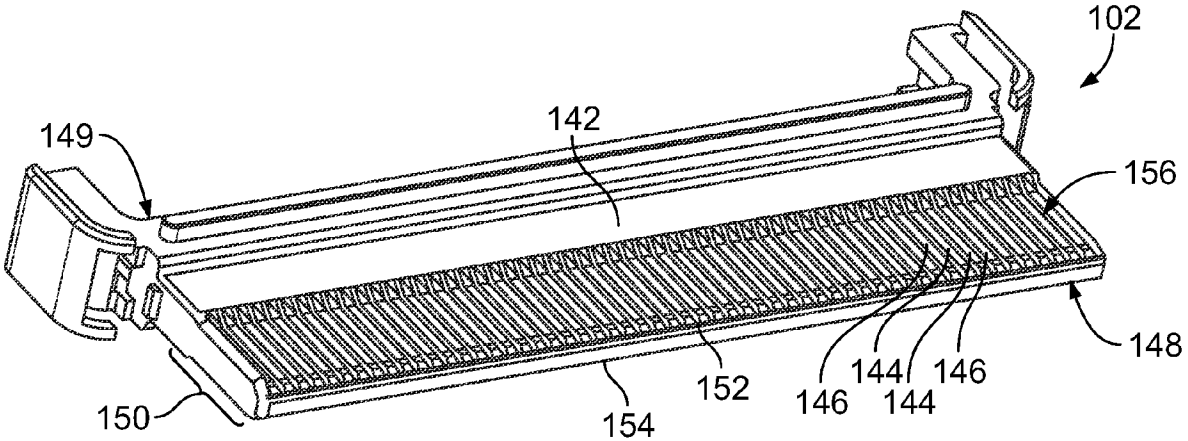
FIG. 2 is a perspective view of a mating connector that mates to the electrical connector according to an embodiment.

FIG. 1 is a perspective view of an electrical connector 100 according to an embodiment. FIG. 2 is a perspective view of a mating electrical connector 102 that mates to the electrical connector 100 shown in FIG. 1 according to an embodiment. The electrical connectors 100, 102 are configured to mate to each other to provide an electrical signal path across the connectors 100, 102. The connectors 100, 102 define a connector system. The electrical connectors 100, 102 may be high speed connectors that transmit data signals at speeds between 25 and 50 gigabits per second (Gb/s), or more. The data signals may be electrical signals conveyed via conductive wires. The electrical connector 100 shown in FIG. 1 is a right angle style board-mount connector that is mounted to a circuit board 104 (shown in phantom). The electrical connector 100 is a right angle connector because the electrical connector 100 receives a mating connector in a mating direction 108 that is parallel to a top surface 106 of the circuit board 104. Alternatively, the electrical connector 100 may be a vertical board-mount connector such that the mating connector is received in a direction that is oblique to, such as perpendicular to, the top surface 106 of the circuit board 104. In alternative embodiments, the electrical connector 100 may be a cable-mount connector, or the like. In the illustrated embodiment shown in FIG. 2, the mating connector 102 is a transceiver style connector that is configured to be terminated to one or more cables, a circuit card, or the like (not shown). The electrical connector 100 may be a receptacle connector that includes a socket 110, and the mating connector 102 may be a plug connector that is configured to be inserted at least partially into the socket 110 as the connectors 100, 102 are mated.

The electrical connector 100 has a housing 112 and contacts held in the housing 112. For example, the housing 112 holds signal contacts 114 and ground contacts 116. The housing 112 has a front end 118 and an opposite, rear end 120. The housing 112 also has a first side wall 122 and a second side wall 124. The first and second side walls 122, 124 define the socket 110 at the front end 118. As used herein, relative or spatial terms such as "front," "rear," "first," "second," "left," and "right" are only used to distinguish the referenced elements and do not necessarily require particular positions or orientations in one or both of the electrical connectors 100, 102 relative to gravity, relative to each other, or relative to the surrounding environment of the electrical connectors 100, 102. For example, in FIG. 1 the housing 112 is a right angle housing. The first side wall 122 is disposed above and defines a top end of the socket 110, and the second side wall 124 is disposed below and defines a bottom end of the socket 110. In an alternative embodiment, depending on the orientation of the electrical connector 100, the first side wall 122 may be disposed on the left of the socket 110, and the second side wall 124 may be disposed on the right of the socket 110. The first side wall 122 extends from the socket 110 to a top 136 of the housing 112, and the second side wall 124 extends from the socket 110 to a bottom 138 of the housing 112. The bottom 138 of the housing 112 abuts or at least faces the top surface 106 of the circuit board 104 on which the housing 112 is mounted. The housing 112 includes first and second end walls 126, 128 that extend between the first and second side walls 122, 124. For example, the first end wall 126 defines a left end of the socket 110, and the second end wall 128 defines a right end of the socket 110.

The signal contacts 114 and the ground contacts 116 are held in the housing 112 along at least one of the first side wall 122 or the second side wall 124. In FIG. 1, the signal contacts 114 and ground contacts 116 are disposed along both the first and second side walls 122, 124, such that the contacts 114, 116 extend in a first row 130 along the first side wall 122 and a second row 132 along the second side wall 124. The first and second rows 130, 132 extend across a width of the housing 112. The signal and ground contacts 114, 116 extend at least partially into the socket 110 from the respective side walls 122, 124 that define the top and bottom ends of the socket 110. For example, the first and second rows 130, 132 of contacts 114, 116 may extend for substantially an entire width of the socket 110 between the first and second end walls 126, 128. The signal and ground contacts 114, 116 in each row 130, 132 are interspersed across the width. For example, the signal and ground contacts 114, 116 may be arranged in a repeating sequence or pattern. In an embodiment, the signal contacts 114 are arranged in pairs. Each pair of signal contacts 114 may define a differential pair that is configured to convey complementary differential signals. Each pair of signal contacts 114 may be separated from a nearest pair of the signal contacts 114 by at least one of the ground contacts 116. Thus, in an embodiment, the signal and ground contacts 114, 116 may be interspersed in a repeating ground-signal-signal-ground-signal-signal pattern. As an alternative to one ground contact 116 between pairs of signal contacts 114, the repeating pattern in another embodiment may be ground-ground-signal-signal-ground-ground-signal-signal, such that two ground contacts 116 are between each pair of signal contacts 114. The first row 130 of contacts 114, 116 need not have the same repeating pattern as the second row 132. In addition, the types, sizes, and/or shapes of the contacts 114, 116 in the first row 130 optionally may differ from the types, sizes, and/or shapes of the contacts 114, 116 in the second row 132. For example, the first row 130 may include high speed contacts, while the second row includes non-high speed, auxiliary contacts used to transmit power and/or data signals.

Figure 7:
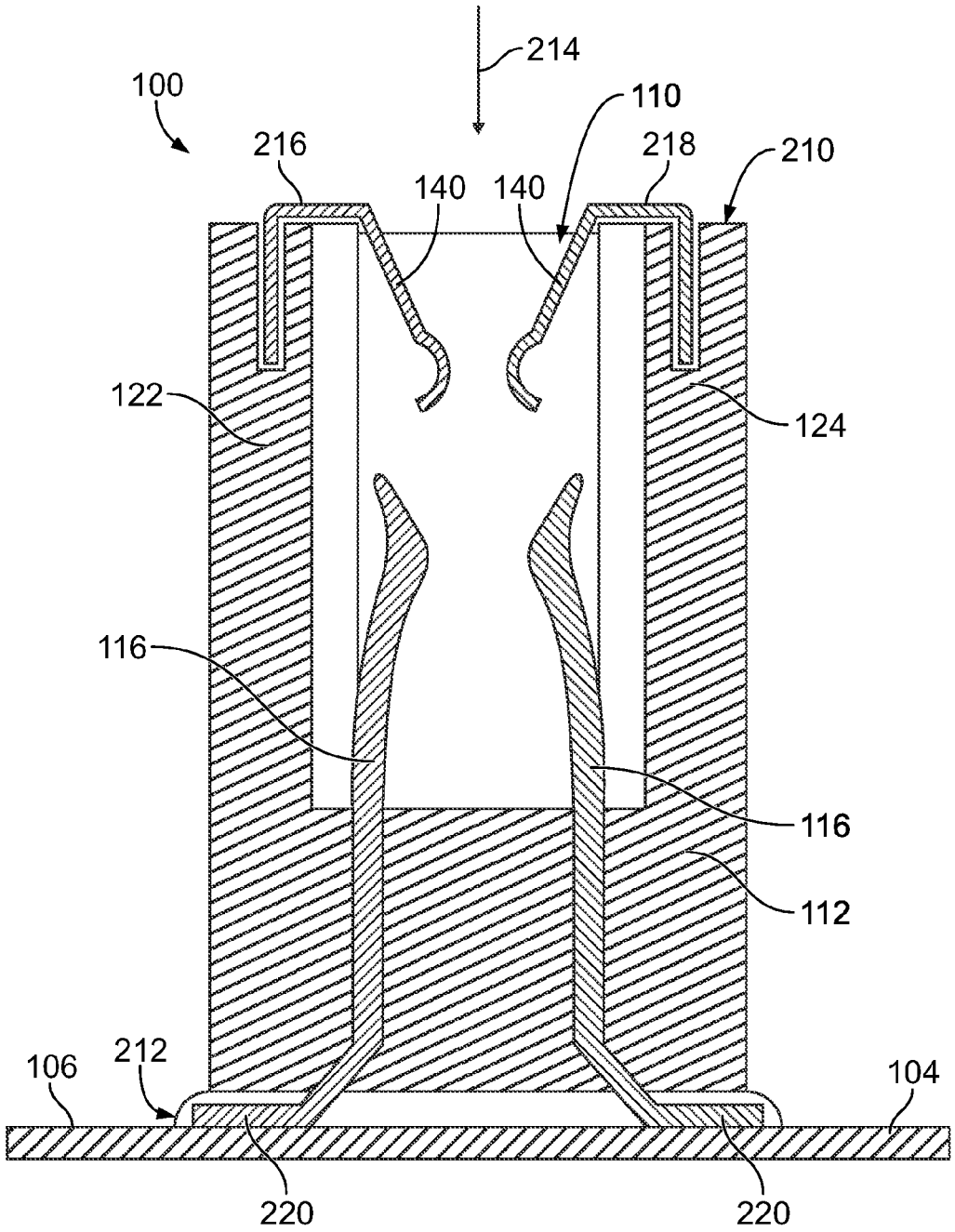
FIG. 7 is a perspective cross-section of the electrical connector according to an alternative embodiment.

The electrical connector 100 also includes a ground bus bar 134 coupled to the housing 112. In FIG. 1, the ground bus bar 134 is coupled to the first side wall 122. Alternatively, the ground bus bar 134 may be coupled to the second side wall 124. Optionally, the ground bus bar 134 coupled to the first side wall 122 is a first ground bus bar 134, and a second ground bus bar is coupled to the second side wall 124, as shown in FIG. 7. The ground bus bar 134 includes spring contacts 140 that extend into the socket 110.

The mating connector 102 in FIG. 2 includes a holder 142. The holder 142 holds mating signal contacts 144 and mating ground contacts 146 in at least one row across a width of the holder 142. The holder 142 has a mating end 148 and an opposite terminating end 149. The terminating end 149 is configured to be terminated to one or more cables, a circuit card, or the like. An interface region 150 of the holder 142 extends to the mating end 148. At the interface region 150, the mating signal contacts 144 and the mating ground contacts 146 are disposed along at least one outer surface of the holder 142 and are exposed for engaging the respective signal contacts 114 and ground contacts 116 of the electrical connector 100. For example, the holder 142 includes a first outer surface 152 and a second outer surface 154 that is opposite to the first outer surface 152. The first outer surface 152 may be an upper surface, and the second outer surface 154 may be a lower surface. The mating signal and ground contacts 144, 146 are disposed at least along the first outer surface 152. Optionally, the mating signal and ground contacts 144, 146 are also disposed along the second outer surface 154. Thus, a first set 156 of contacts 144, 146 extends along the first outer surface 152, and a second set (not shown) extends along the second outer surface 154. The mating signal and ground contacts 144, 146 of the first set 156 are interspersed along the width of the holder 142. For example, the contacts 144, 146 are arranged in a repeating sequence or pattern that mirrors the repeating sequence of the signal and ground contacts 114, 116 of the electrical connector 100. For example, the first set 156 may be arranged in a ground-signal-signal-ground-signal-signal pattern.

To mate the connectors 100, 102, the interface region 150 of the mating connector 102 is advanced in the mating direction 108 into the socket 110 of the electrical connector 100 through the front end 118. The mating connector 102 may be oriented such that the first outer surface 152 faces the first side wall 122 of the electrical connector 100, and the mating signal and ground contacts 144, 146 along the first outer surface 152 engage the respective signal and ground contacts 114, 116 in the first row 130. Conversely, the second outer surface 154 of the mating connector 102 faces the second side wall 124, and the mating signal and ground contacts 144, 146 along the second outer surface 154 (although not shown in FIG. 2) engage the respective signal and ground contacts 114, 116 in the second row 132. The engagement between corresponding mating signal contacts 144 and signal contacts 114 provides electrical signal paths between and across the connectors 100, 102. The engagement between corresponding mating ground contacts 146 and ground contacts 116 provides electrical shielding between the electrical signal paths and also provides electrical grounding paths between and across the connectors 100, 102.

In an embodiment, as the interface region 150 of the mating connector 102 enters the socket 110, the spring contacts 140 of the ground bus bar 134 on the receptacle housing 112 engage corresponding mating ground contacts 146 of the mating connector 102. The engagement between the spring contacts 140 and the mating ground contacts 146 may occur in sequence with the engagement between the mating ground contacts 146 and the ground contacts 116. Thus, the same mating ground contact 146 of the mating connector 102 may separately engage one spring contact 140 and one ground contact 116 at two different connection points, as described further below with reference to FIG. 6. By separately engaging the mating ground contacts 146 with the spring contacts 140 and the ground contacts 116, the spring contacts 140 do not interfere with the connection between the ground contacts 116 and the mating ground contacts 146 (such as by causing misalignment or altering the normal forces at the connection point). The spring contacts 140 of the ground bus bar 134 engage the mating ground contacts 146 to electrically common the mating ground contacts 146 of the mating connector 102. By commoning the mating ground contacts 146 within the socket 110, the ground bus bar 134 may reduce electrical interference, such as cross-talk and resonant frequency noise spikes, thereby improving the electrical performance of the mated connectors 100, 102.

Figure 3:
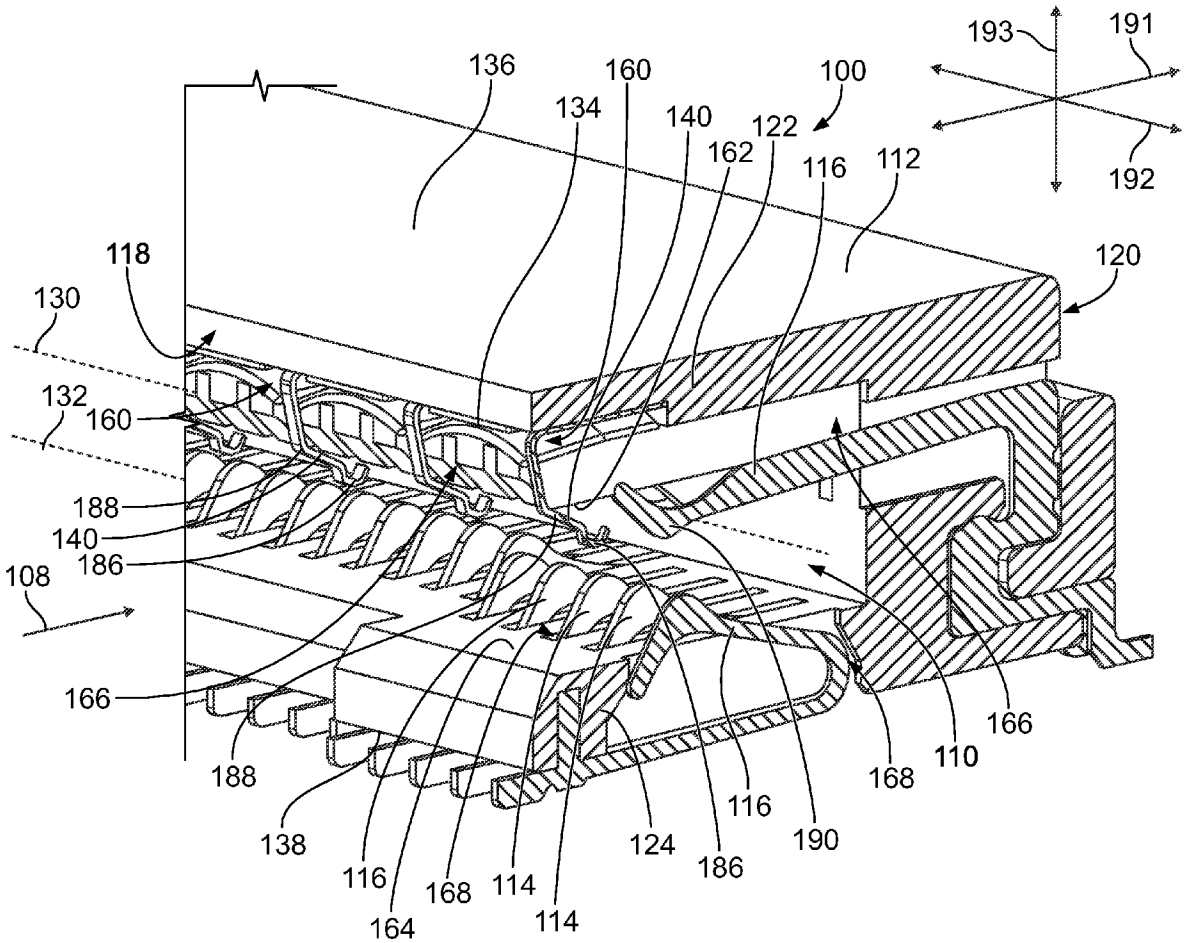
FIG. 3 is a perspective cross-section of the electrical connector according to an embodiment.

FIG. 3 is a perspective cross-section of the electrical connector 100 according to an embodiment. The ground contacts 116 in the illustrated embodiment are held along the first side wall 122 of the housing 112 as well as along the second side wall 124. The ground contacts 116 in the first row 130 along the first side wall 122 are configured to engage the first set 156 (shown in FIG. 2) of mating ground contacts 146 (FIG. 2) of the mating connector 102 (FIG. 2). Likewise, the ground contacts 116 in the second row 132 along the second side wall 124 are configured to engage mating ground contacts 146 disposed along the second outer surface 154 (shown in FIG. 2) of the holder 142 (FIG. 2) of the mating connector 102. The cross-section in FIG. 3 extends through the housing 112, a ground contact 116 in the first or upper row 130, a ground contact 116 in the second or lower row 132, and a spring contact 140 of the ground bus bar 134. In order to better illustrate the spring contacts 140, the signal contacts 114 (shown in FIG. 1) in the first row 130 are not shown in FIG. 3. The connector 100 is oriented with respect to a longitudinal or mating axis 191, a lateral axis 192, and a vertical or elevation axis 193. The axes 191-193 are mutually perpendicular. Although the elevation axis 193 appears to extend in a vertical direction parallel to gravity in FIG. 3, it is understood that the axes 191-193 are not required to have any particular orientation with respect to gravity.

The housing 112 extends along the mating axis 191 between the front end 118 and the rear end 120. The housing 112 defines a slot 160 in the first side wall 122. The ground bus bar 134 is disposed within the slot 160. The spring contacts 140 of the ground bus bar 134 extend from the slot 160 at least partially into the socket 110 of the housing 112. In an embodiment, the slot 160 is defined in the front end 118 of the housing 112 and extends rearward (towards the rear end 120) along the mating axis 191. The slot 160 retains the ground bus bar 134 by an interference fit. The spring contacts 140 of the ground bus bar 134 extend from the slot 160 at the front end 118 downward along the elevation axis 193 into the socket 110. In an embodiment, the spring contacts 140 may extend at least partially rearward along the mating axis 191 towards the ground contacts 116 in the first row 130. In an alternative embodiment, the slot 160 may extend from the top 136 of the housing 112 or from an interior surface 162 of the first side wall 122 instead of extending from the front end 118. The interior surface 162 of the first side wall 122 defines the top of the socket 110, and the ground contacts 116 (as well as the signal contacts 114 that are not shown) of the first row 130 protrude from the interior surface 162 into the socket 110. In an alternative embodiment, the spring contacts 140 may protrude from the slot 160 through the first side wall 122 and directly into the socket 110, instead of extending along the front end 118 of the housing 112. Optionally, the interior surface 162 of the first side wall 122 defines apertures 166 that align with the ground contacts 116 and the signal contacts (not shown) of the first row 130. The apertures 166 provide space for the ground contacts 116 and signal contacts to deflect outwards (towards the top 136 of the housing 112) upon the interface region 150 (shown in FIG. 2) of the mating connector 102 (FIG. 2) being received in the socket 110. In addition, an interior surface 164 of the second side wall 124 may also define apertures 168 that provide space for the signal contacts 114 and the ground contacts 116 of the second row 132 to deflect outwards (towards the bottom 138 of the housing 112) upon receiving the interface region 150 in the socket 110. In an alternative embodiment, the ground bus bar 134 may be fastened, soldered, glued, or otherwise adhered to the top 136, front end 118, and/or interior surface 162 of the first side wall 122 to couple the ground bus bar 134 to the first side wall 122 instead of inserting the ground bus bar 134 in the slot 160.

Figure 4:
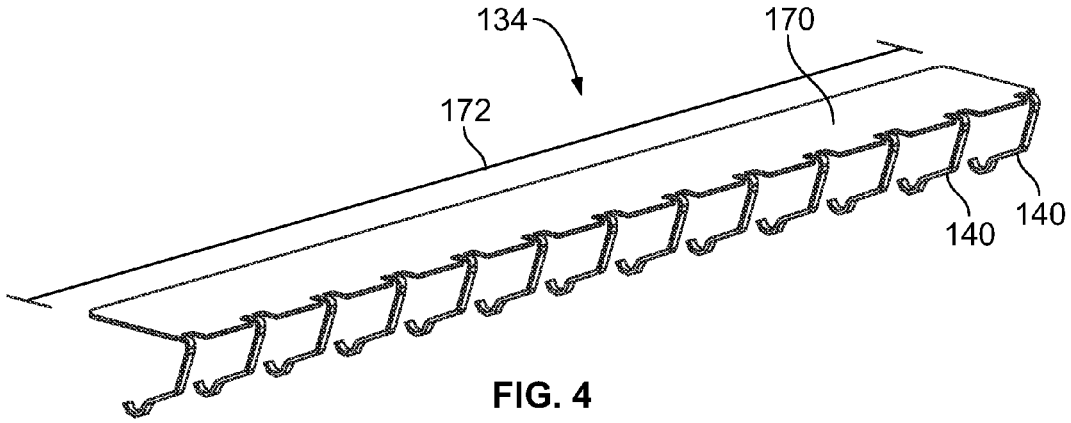
FIG. 4 is a perspective view of a ground bus bar of the electrical connector according to an embodiment.

FIG. 4 is a perspective view of the ground bus bar 134 of the electrical connector 100 (shown in FIG. 1) according to an embodiment. The ground bus bar 134 includes a planar base 170 that has a width 172. The width 172 may be the width of the socket 110 (shown in FIG. 1). In an alternative embodiment, the width of the ground bus bar 134 may be less than the width of the socket 110, and multiple ground bus bars are configured to be placed side by side in the slot 160 (shown in FIG. 3). The spring contacts 140 extend from the base 170 at spaced apart locations along the width 172. The spring contacts 140 are spaced apart from each other to allow the spring contacts 140 to engage the mating ground contacts 146 (shown in FIG. 2) of the mating connector 102 (FIG. 2) without engaging the mating signal contacts 144 (FIG. 2) disposed between the mating ground contacts 146.

Figure 5:
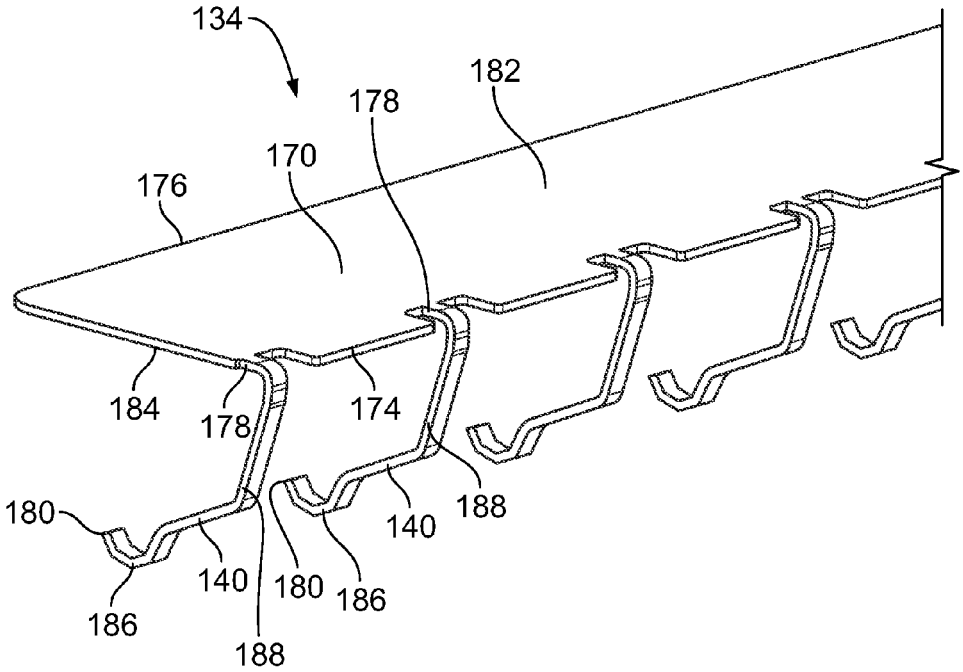
FIG. 5 is a close-up view of a portion of the ground bus bar.

FIG. 5 is a close-up view of a portion of the ground bus bar 134 shown in FIG. 4. The base 170 of the ground bus bar 134 has a front edge 174 and a rear edge 176. In an embodiment, the spring contacts 140 extend from the front edge 174. For example, the spring contacts 140 are cantilevered beams that have a fixed end 178 at the base 170 and an opposite free end 180 that is positioned away from the base 170. The fixed end 178 may be at the front edge 174 of the base 170. The base 170 also has a first side 182 and a second side 184. In FIG. 5, the first side 182 is a top side and the second side 184 is a bottom side. The spring contacts 140 may extend downwards from the base 170 such that the free ends 180 are disposed below the second side 184 of the base 170. Since the ground bus bar 134 is coupled to the first side wall 122 (shown in FIG. 1) of the housing 112 (FIG. 1), the free ends 180 extend into the socket 110 (FIG. 1) below the first side wall 122. The cantilevered spring contacts 140 each have a mating portion 186 at or proximate to the free end 180 and an arm 188 between the mating portion 186 and the fixed end 178. The arm 188 is deflectable. The mating portion 186 may have a U-shaped curve to prevent damage to the spring contact 140 and/or the mating ground contact 146 (shown in FIG. 2) as the mating ground contact 146 engages and moves relative to the spring contact 140 during mating and un-mating of the connectors 100, 102 (shown in FIGS. 1 and 2, respectively).

Optionally, the ground bus bar 134 may be stamped and formed of a conductive metal material or compound. For example, the spring contacts 140 and the base 170 may be stamped from a common panel of sheet metal, and the spring contacts 140 are bent out of plane such that the free ends 180 are below the second side 184. Although the first and second sides 182, 184 of the base 170 in FIG. 5 are solid without holes extending therethrough, in an alternative embodiment, the spring contacts 140 may be sheared or cut from the base 170 and bent out of plane. In an alternative embodiment, the spring contacts 140 may extend from the rear edge 176 of the base 170 instead of, or in addition to, the front edge 174. For example, a first set of contacts 140 may extend from the front edge 174 and a second set of contacts 140 may extend from the rear edge 176, where the sets of spring contacts 140 are configured to engage the corresponding mating ground contacts 146 (shown in FIG. 2) at different connection points. In another example, instead of being cantilevered beams, the spring contacts 140 alternatively may be tabs drawn out of the plane of the base 170, where both ends of the tabs are connected to (for example, integral with) the base 170.

Referring now back to FIG. 3, as the interface region 150 (shown in FIG. 2) of the mating connector 102 (FIG. 2) is received in the socket 110, the cantilevered spring contacts 140 align with and engage corresponding mating ground contacts 146 (FIG. 2) of the mating connector 102. For example, the mating ground contacts 146 engage the mating portions 186 of the spring contacts 140 as the mating ground contacts 146 move in the mating direction 108. The mating ground contacts 146 cause the arms 188 of the corresponding spring contacts 140 to deflect at least partially rearward and outward towards the interior surface 162. When the spring contacts 140 are deflected from an un-deflected position within the socket 110, the spring contacts 140 apply a biasing force on the corresponding mating ground contacts 146. The biasing force retains engagement between the spring contacts 140 and the corresponding mating ground contacts 146.

With continued reference to FIG. 3, the ground contacts 116 of the electrical connector 100 have mating portions 190 that are configured to engage the corresponding mating ground contacts 146 (shown in FIG. 2). In an embodiment, the mating portions 186 of the spring contacts 140 are offset longitudinally from the mating portions 190 of the ground contacts 116 along the mating axis 191. For example, the mating portions 186 of the spring contacts 140 may be located more proximate to the front end 118 of the housing 112 than the mating portions 190 of the ground contacts 116. The mating portions 186, 190 are offset from each other in order to engage the corresponding mating ground contacts 146 at different, spaced apart connection points. In an embodiment, the spring contacts 140 of the ground bus bar 134 are aligned with corresponding ground contacts 116 of the electrical connector 100 in respective planes perpendicular to the lateral axis 192. For example, as shown in FIG. 3, the cross-section extends through one of the spring contacts 140 as well as one of the ground contacts 116 of the first row 130, which indicates that the spring contact 140 and the ground contact 116 are aligned in a plane perpendicular to the lateral axis 192. The spring contacts 140 are aligned with the ground contacts 116 in order to engage the corresponding mating ground contacts 146. Therefore, one mating ground contact 146 will engage both a spring contact 140 and a ground contact 116. Since the mating portions 186, 190 of the spring contacts 140 and the ground contacts 116, respectively, are offset longitudinally, the mating ground contact 146 engages the spring contact 140 and the ground contact 116 at respective different connection points, as will be described below.

Figure 6:
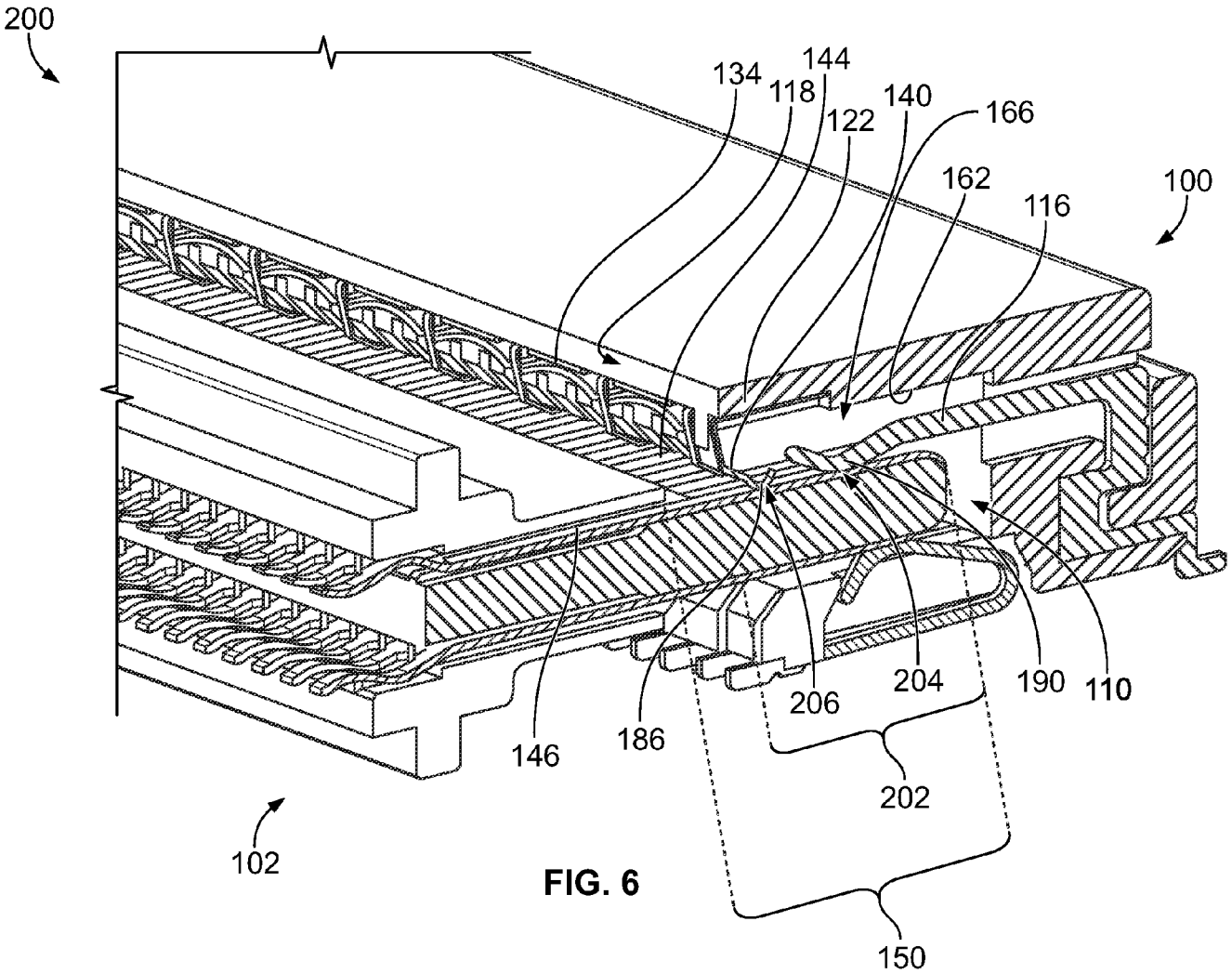
FIG. 6 is a perspective cross-section of a portion of a connector system including the electrical connector and the mating connector according to an embodiment.

FIG. 6 is a perspective cross-section of a portion of a connector system 200 including the electrical connector 100 and the mating connector 102 according to an embodiment. As the interface region 150 of the mating connector 102 enters the socket 110 of the electrical connector 100, a mating zone 202 is defined within the socket 110. The mating ground contacts 146 of the mating connector 102 engage the spring contacts 140 of the ground bus bar 134 and engage the ground contacts 116 of the electrical connector 100 in the mating zone 202. As shown in FIG. 6, the spring contacts 140 and the ground contacts 116 are deflected outwards by the mating ground contacts 146 towards the interior surface 162 of the first side wall 122 and/or into the apertures 166 in the first side wall 122. In addition, although not shown in FIG. 6, the mating signal contacts 144 of the mating connector 102 engage the corresponding signal contacts 114 (shown in FIG. 1) of the electrical connector 100 in the mating zone 202. As shown in the cross-section, the mating portion 190 of the ground contact 116 engages the mating ground contact 146 at a first ground connection point 204, and the mating portion 186 of the spring contact 140 of the ground bus bar 134 engages the mating ground contact 146 at a second ground connection point 206. The second ground connection point 206 is more proximate to the front end 118 of the housing 112 than the first ground connection point 204. The spaced-apart connection points 204, 206 ensure that the spring contacts 140 do not interfere with the engagement between the ground contacts 116, 146 of the connectors 100, 102, respectively. For example, the spring contacts 140 coupled to the housing 112 of the electrical connector 100 may not engage the ground contacts 116 of the electrical connector 100, even upon mating with the mating connector 102. Thus, the connector system 200 avoids problems with compounding normal forces and aligning three mating components that are known in the art.

The ground contacts 116 of the electrical connector 100 engage the mating ground contacts 146 of the mating connector 102 at the first connection points 204 to provide a ground path across the mating zone 202. The engagement between the ground contacts 116 and the mating ground contacts 146 also provides shielding along the signal paths between mated sets of signal contacts 114 (shown in FIG. 1) and mating signal contacts 144. The spring contacts 140 of the ground bus bar 134 engage the mating ground contacts 146 to electrically common the mating ground contacts 146 in the mating zone 202. By electrically connecting the mating ground contacts 146 to each other, the ground bus bar 134 creates a ground circuit between the corresponding mating ground contacts 146 that are engaged by the spring contacts 140. The ground circuit may provide multiple alternate paths for a return signal because the ground circuit provides more than one path to ground. By engaging the mating ground contacts 146 within the mating zone 202 proximate to where the mating ground contacts 146 engage the ground contacts 116, the ground bus bar 134 shortens an effective length of the ground path between the two connectors 100, 102. The effective length of the ground path may be a distance between locations where the grounding elements are electrically commoned. The ground bus bar 134 may split the effective length of the ground path, such as in half. By reducing the effective length of the ground path, electrical interference, such as noise spikes, across the mating zone 202 is reduced. Additionally, the resonance frequency across the mating zone 202 may increase to a value above which the signals are communicated through the connectors 100, 102, which improves performance of the connector system 200.

FIG. 7 is a perspective cross-section of the electrical connector 100 according to an alternative embodiment. The electrical connector 100 is a vertical hoard-mount connector that is mounted to a circuit board 104. For example, the electrical connector 100 includes ground contacts 116 that have tails 220 that electrically terminate to the circuit board 104, such as through soldering or, alternatively, through-hole mounting. The electrical connector 100 has a housing 112 that includes a mating end 210 and an opposite mounting end 212. The mounting end 212 mounts to the circuit board 104, and the mating end 210 defines a socket 110 that receives a mating connector (such as the mating connector 102 shown in FIG. 2) therein. The mating connector is received in the socket 110 in a mating direction 214 that is perpendicular to a top surface 106 of the circuit board 104.

The electrical connector 100 includes a first side wall 122 and a second side wall 124 that define the socket 110 therebetween. The first side wall 122 is disposed on the left of the socket 110, and the second side wall 124 is on the right of the socket 110. In the illustrated embodiment, a first ground bus bar 216 is coupled to the first side wall 122, and a second ground bus bar 218 is coupled to the second side wall 124. The first and second ground bus bars 216, 218 may each be similar to the ground bus bar 134 shown in FIG. 3. For example, the spring contacts 140 of the first ground bus bar 216 may be configured to engage a first set of mating ground contacts of the mating connector (such as the mating ground contacts 146 in the first set 156 shown in FIG. 2). In addition, the spring contacts 140 of the second ground bus bar 218 may be configured to engage a second set of mating ground contacts of the mating connector. The second set of mating ground contacts may be on an opposite outer surface of the mating connector as the first set.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a front end and an opposite rear end, the housing having a first side wall and a second side wall defining a socket at the front end, the socket being configured to receive a mating connector therein;

signal contacts and ground contacts held in the housing along at least one of the first or second side wall, the signal contacts and the ground contacts interspersed across a width of the housing, the signal contacts and the ground contacts extending into the socket to engage corresponding mating signal contacts and mating ground contacts, respectively, of the mating connector; and a ground bus bar coupled to the housing at the first side wall of the socket, the ground bus bar including spring contacts that extend into the socket and are configured to engage corresponding mating ground contacts of the mating connector to electrically common the mating ground contacts, the spring contacts aligning with the ground contacts such that one of the spring contacts and a corresponding ground contact that aligns with the one spring contact engage a same mating ground contact of the mating connector at different, spaced-apart connection points.

2. The electrical connector of claim 1, wherein the housing defines a slot in the first side wall at the front end of the housing, the ground bus bar being disposed within the slot, the spring contacts of the ground bus bar extending from the slot into the socket.

3. The electrical connector of claim 2, wherein the slot in the first side wall is spaced apart from the socket, the spring contacts extending from the slot into the socket through a front opening of the socket.

4. The electrical connector of claim 1, wherein the ground bus bar includes a planar base having a width, the spring contacts extending from the base at spaced apart locations along the width of the base such that the spring contacts engage corresponding mating ground contacts but do not engage the mating signal contacts interspersed with the mating ground contacts.

5. The electrical connector of claim 1, wherein the ground bus bar includes a planar base that has a front edge and a rear edge, the spring contacts are cantilevered with a fixed end at the front edge of the base and a free end in the socket, the spring contacts extending rearward towards the rear end of the housing.

6. The electrical connector of claim 5, wherein the spring contacts extend from the front edge of the base along an interior surface of the first side wall of the socket, the spring contacts configured to deflect towards the interior surface upon engaging the corresponding mating ground contacts, the spring contacts configured to apply a biasing force on the corresponding mating ground contacts to retain engagement with the mating ground contacts.

7. The electrical connector of claim 1, wherein the housing extends along a mating axis between the front and rear ends, the spring contacts and the ground contacts having respective mating portions configured to engage the mating ground contacts of the mating connector, the mating portions of the spring contacts of the ground bus bar being offset from the mating portions of the ground contacts along the mating axis such that the mating portions of the spring contacts are located more proximate to the front end of the housing than a proximity of the mating portions of the ground contacts to the front end of the housing.

8. The electrical connector of claim 1, wherein the ground bus bar coupled to the housing at the first side wall of the socket is a first ground bus bar and the electrical connector further includes a second ground bus bar coupled to the housing at the second side wall of the socket, the first ground bus bar configured to engage a first set of mating ground contacts of the mating connector, the second ground bus bar configured to engage a different, second set of mating ground contacts of the mating connector.

9. The electrical connector of claim 1, wherein the ground bus bar creates a ground circuit between the corresponding mating ground contacts engaged by the spring contacts of the ground bus bar.

10. The electrical connector of claim 1, wherein the signal contacts are arranged in pairs, each pair of signal contacts separated from a nearest pair of signal contacts by at least one of the ground contacts.

11. The electrical connector of claim 1, wherein the housing extends along a mating axis between the front and rear ends, the one spring contact engaging the corresponding mating ground contact of the mating connector at a first connection point, the corresponding ground contact engage the same mating ground contact at a second connection point, the first connection point being disposed between the front end of the housing and the second connection point along the mating axis.

12. The electrical connection of claim 1, wherein the housing extends along a mating axis between the front and rear ends, the spring contacts aligning with the ground contacts along the mating axis, the spring contacts being spaced apart from the corresponding ground contacts along the mating axis such that the spring contacts do not engage the ground contacts.

13. A connector system comprising:

an electrical connector including a housing having a front end and an opposite rear end, the housing having a first side wall and a second side wall defining a socket at the front end, the housing holding signal contacts and ground contacts along at least one of the first or second side wall, the signal contacts and the ground contacts interspersed across a width of the housing and extending into the socket, the electrical connector further including a ground bus bar coupled to the housing at the first side wall of the socket, the ground bus bar having spring contacts that extend into the socket, the spring contacts aligning with the ground contacts; and a mating connector including a holder having an interface region, the holder holding mating signal contacts and mating ground contacts along at least one outer surface of the holder at the interface region, the mating signal contacts and the mating ground contacts interspersed across a width of the holder, wherein, as the electrical connector and the mating connector are mated, the interface region of the mating connector is received in the socket of the electrical connector, the mating ground contacts of the mating connector engaging both the spring contacts of the ground bus bar and the ground contacts such that one of the mating ground contacts engages a corresponding spring contact at a first connection point and engages a corresponding ground contact that aligns with the spring contact at a second connection point that is spaced apart from the first connection point, the mating signal contacts of the mating connector engaging the signal contacts of the electrical connector.

14. The connector system of claim 13, wherein the housing defines a slot in the first side wall at the front end of the housing, the ground bus bar being disposed within the slot, the spring contacts of the ground bus bar extending from the slot into the socket.

15. The connector system of claim 13, wherein the ground bus bar includes a planar base having a width, the spring contacts extending from the base at spaced apart locations along the width of the base such that the spring contacts engage corresponding mating ground contacts of the mating connector but do not engage the mating signal contacts interspersed with the mating ground contacts.

16. The connector system of claim 13, wherein the mating connector mates to the electrical connector along a mating axis, the ground contacts having mating portions that engage the corresponding mating ground contacts at the second connection points, the spring contacts of the ground bus bar having mating portions that engage the corresponding mating ground contacts at the first connection points, the first connection points being more proximate to the front end of the housing along the mating axis than a proximity of the second connection points to the front end of the housing.

17. The connector system of claim 13, wherein the ground bus bar includes a planar base that has a front edge and a rear edge, the spring contacts are cantilevered with a fixed end at the front edge of the base and a free end in the socket, the spring contacts extending rearward towards the rear end of the housing.

18. The connector system of claim 17, wherein the spring contacts extend from the front edge of the base along an interior surface of the first side wall of the socket, the spring contacts configured to deflect towards the interior surface upon engaging the corresponding mating ground contacts, the spring contacts configured to apply a biasing force on the corresponding mating ground contacts to retain engagement with the mating ground contacts.

19. The connector system of claim 13, wherein the ground contacts of the electrical connector are held along both the first side wall and the second side wall of the housing, the ground contacts along the first side wall engaging a first set of mating ground contacts of the mating connector, the ground contacts along the second side wall engaging a second set of mating ground contacts of the mating connector, wherein the ground bus bar coupled to the housing at the first side wall is a first ground bus bar that is configured to engage the first set of mating ground contacts, and the electrical connector further includes a second ground bus bar coupled to the housing at the second side wall that is configured to engage the second set of mating ground contacts.

20. The connector system of claim 13, wherein the ground contacts of the electrical connector engage the mating ground contacts of the mating connector to provide a ground path across a mating zone that is defined within the socket, and wherein the spring contacts of the ground bus bar engage the mating ground contacts to electrically common the mating ground contacts in the mating zone and shorten an effective length of the ground path across the mating zone.

* * * * *